United States Patent [19]

Bates

[11] Patent Number: 4,598,791

[45] Date of Patent: Jul. 8, 1986

[54] EXHAUST SILENCER

[75] Inventor: Stanley Bates, Broseley, England

[73] Assignee: Chillcotts Limited, Madeley, England

[21] Appl. No.: 588,965

[22] Filed: Mar. 13, 1984

[30] Foreign Application Priority Data

Mar. 17, 1983 [GB] United Kingdom ..... 8307371

[51] Int. Cl.[4] ..... F01N 1/08

[52] U.S. Cl. ..... 181/264; 181/244; 181/268; 181/272; 181/282

[58] Field of Search ..... 181/231, 244, 258, 264–266, 181/268, 270, 272, 275, 281, 282, 251

[56] References Cited

U.S. PATENT DOCUMENTS 2,075,316 3/1937 Tyden ..... 181/251
3,163,256 12/1964 Lanning ..... 181/264 X
3,987,867 10/1976 Moller ..... 181/237
4,105,089 8/1978 Judd ..... 181/264
4,382,487 5/1983 Baumann ..... 181/245 X

FOREIGN PATENT DOCUMENTS 815867 10/1951 Fed. Rep. of Germany ..... 181/275
1339526 4/1972 United Kingdom .

*Primary Examiner*—Benjamin R. Fuller
*Attorney, Agent, or Firm*—Charles E. Pfund

[57] ABSTRACT

An exhaust silencer for an internal combustion engine, has an inlet, a noise-attenuation chamber containing a noise-attenuation matrix, and an outlet. The noise-attenuation chamber is of rectangular cross-section, and has one transverse dimension which is substantially larger than the other transverse dimension. The noise-attenuation matrix is constituted by a plurality of flat plates made of a material which is heat resistant and corrosion resistant, the plates being placed in spaced parallel relationship.

10 Claims, 6 Drawing Figures

2/2

EXHAUST SILENCER

BACKGROUND TO THE INVENTION

This invention relates to an exhaust silencer for an internal combustion engine of the type used in motor vehicles.

The increasing demands for lower noise levels from motor vehicles powered by internal combustion engines has meant that their exhaust silencers have had to be made of ever increasing size. As the usual type of exhaust silencer is of oval or circular cross-section, the increases in diameter begin to pose a problem for the vehicle manufacturer with regard to ground clearance, owing to the limited space available.

The aim of the invention is to provide an exhaust silencer within improved noise-attenuation properties but of very shallow depth.

SUMMARY OF THE INVENTION

The present invention provides an exhaust silencer for an internal combustion engine, the silencer having an inlet, a noise-attenuation chamber containing a noise-attenuation matrix, and an outlet, wherein the noise-attenuation chamber is of rectangular cross-section and has one transverse dimension which is substantially larger than the other transverse dimension, and wherein the noise-attenuation matrix is constituted by a plurality of flat plates made of a material which is heat resistant and corrosion resistant, the plates being placed in spaced parallel relationship.

Thus, by arranging the silencer so that the smaller dimension of the noise-attenuation chamber is the height of that chamber, the silencer can be positioned under a motor vehicle with adequate ground clearance. Moreover, the noise-reducing properties of this silencer can be increased by increasing the other dimension (length) of the noise-attenuation chamber.

Advantageously, the ratio of the transverse dimensions of the noise-attenuation chamber is at least 3:1.

In a preferred embodiment, the noise-attenuation chamber is constituted by a rectangular duct made of metal, the noise-attenuation matrix being housed within the duct. Preferably, the plates are equispaced. The plates may be made of ceramic fibre board or stainless steel. Conveniently, the plates of each pair of adjacent plates are spaced apart by means of at least two separating strips, the separating strips extending longitudinally with respect to the noise-attenuation chamber in the direction of gas flow, and the separating strips being made of a heat-resistant material. In this case, the separating strips may also be made of ceramic fibre board.

Advantageously, the plates each have a thickness which is substantially equal to the spacing between adjacent plates. Conveniently, the plates are spaced apart by distances laying within the range of from 0.1 millimeters to 1.5 millimeters, and preferably within the range of from 0.4 millimeters to 1.0 millimeters.

The inlet may include a perforated inlet pipe. Preferably, the inlet pipe is mounted within a rectangular box. Alternatively, the inlet pipe is mounted within a tubular member which is fixed to the noise-attenuation chamber, the tubular member being provided with an elongate aperture which opens into the noise-attenuation chamber. In this case, the inlet pipe may be held within the tubular member by means of two apertured plates, the perforated portion of the inlet pipe being positioned between the two apertured plates.

Advantageously, the inlet pipe contains a nozzle, the nozzle being provided within a portion of the inlet not in the flow path of gas to the noise-attenuation chamber, and the silencer further comprises a collection chamber positioned downstream of the nozzle. Where the inlet pipe is mounted within a rectangular box, an extension of the inlet pipe may constitute the collection chamber. Where the inlet pipe is mounted within a tubular member, however, it is preferable if the inlet pipe terminates in the nozzle, and an extension of the tubular member constitutes the collection chamber.

The outlet may be constituted by a tubular member and an outlet pipe, the tubular member having an elongate aperture through which exhaust gas can pass from the noise-attenuation chamber to the outlet pipe. Alternatively, the outlet may be constituted by an outlet pipe mounted within a rectangular box connected to the noise-attenuation chamber.

BRIEF DESCRIPTION OF THE DRAWINGS

Two forms of exhaust silencer, each of which is constructed in accordance with the invention, will now be described, by way of example, with reference to the accompanying drawings, in which.

DESCRIPTION OF PREFERRED EMBODIMENTS

Figure 1:
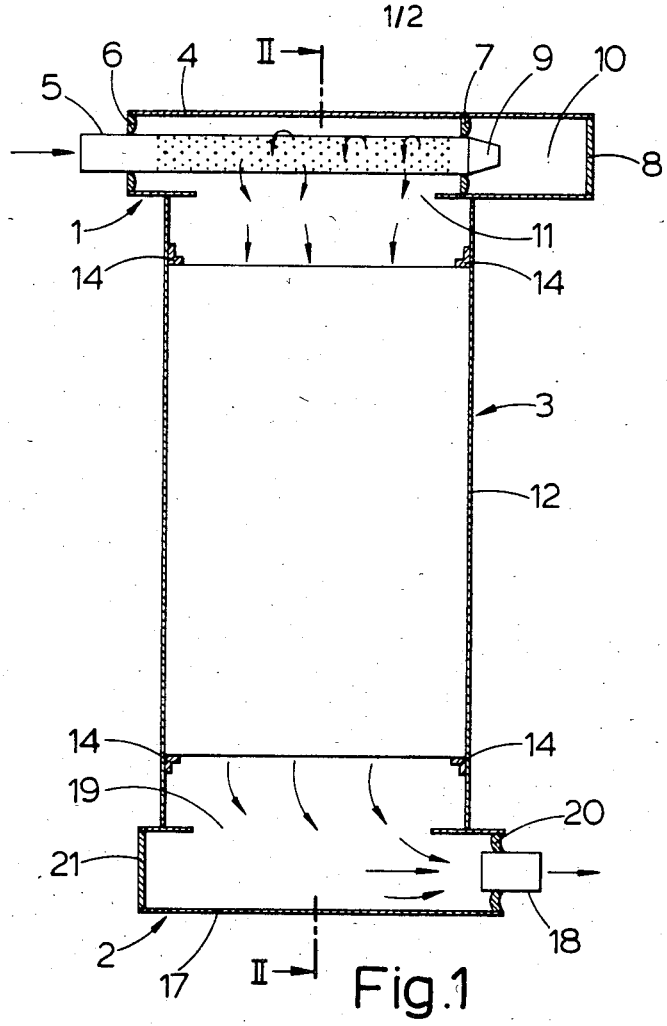
FIG. 1 is a schematic part-sectional plan view of the first form of silencer.
Figure 2:
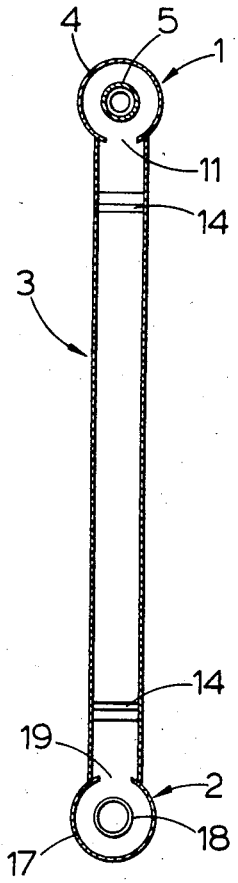
FIG. 2 is a schematic cross-section taken on the line II—II of FIG. 1.

Referring to the drawings, FIG. 1 shows a motor vehicle exhaust silencer having an inlet section 1, an outlet section 2, and a noise-attenuation section 3 positioned between the inlet and outlet sections. The inlet section 1 is constituted by a tubular member 4, and an inlet pipe 5. The tubular member 4 is made of sheet metal. The inlet pipe 5 passes through one end of the tubular member 4, and is held firmly in position by means of an apertured end closure plate 6 and an apertured support plate 7. The other end of the tubular member 4 is closed off by an end closure plate 8. The inlet pipe 5 is connected to the exhaust manifold (not shown) of an internal combustion engine. The portion of the inlet pipe 5 within the tubular member 4 is perforated to permit exhaust gases to pass from the pipe into the tubular member (as indicated by the arrows). The perforated portion of the inlet pipe 5 lies within the portion of the tubular member 4 that is positioned between the end closure plate 6 and the support plate 7, the free end of the pipe terminating in a short nozzle 9 which opens into a collection chamber 10. The tubular member 4 is formed with an elongate aperture 11 which permits the exhaust gas to flow from the tubular member into the noise-attenuation section 3.

Figure 4:
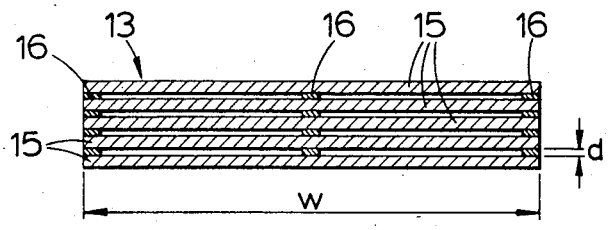
FIG. 4 is a cross-section taken on the line IV—IV of FIG. 3.

The noise-attenuation section 3 is constituted by a rectangular box-shaped housing 12 which contains a matrix 13. The matrix 13 is secured within the housing 12 by means of angle irons 14. The housing 12 is made of sheet metal such as mild steel, and the matrix 13 is constituted by five flat plates 15 made of a suitable heat-resistant and corrosion resistant material such as ceramic fibre board or stainless steel, the flat plates being equispaced in parallel juxtaposition with separating strips 16 bonded to the plates by an appropriate heat-resistant cement (see FIG. 4). The separating strips 16 are also made of ceramic fibre board or stainless steel. As shown in FIG. 4, the separating strips 16 are positioned longitudinally in the direction of gas flow. In the embodiment shown, there are three separating strips 16 between each pair of flat plates 15. The number of separating strips 16 required is determined by the width $^{w}$ of the matrix 13, and is so chosen that the distance between adjacent separating strips is small enough to eliminate the possibility of the plates 15 touching should the plates distort slightly during use.

The outlet section 2 is constituted by a tubular member 17 and an outlet pipe 18. The tubular member 17 is made of sheet metal. The tubular member 17 is formed with an elongate aperture 19, which permits the exhaust gas to flow into the tubular member from the noise-attenuation section 3. The outlet pipe 18 is held within one end of the tubular member 17 by an apertured end plate 20. The other end of the tubular member 17 is closed by an end plate 21. An extension pipe (not shown) may be fitted to the outlet pipe 18 for discharging the exhaust gas to a suitable position.

In use, the exhaust gas enters the silencer via the inlet pipe 5. Any heavy particles present in the gas are projected through the nozzle 9 into the collection chamber 10. The exhaust gas flows into the tubular member 4 through the perforated portion of the inlet pipe 5. The exhaust gas then flows through the matrix 13 within the noise-attenuation section 3. The matrix 13 separates the gas flow into a number of shallow streams of depth $^{d}$ and length $^{l}$ (see FIGS. 3 and 4). The exhaust gas then leaves the silencer via the outlet section 2.

Figure 5:
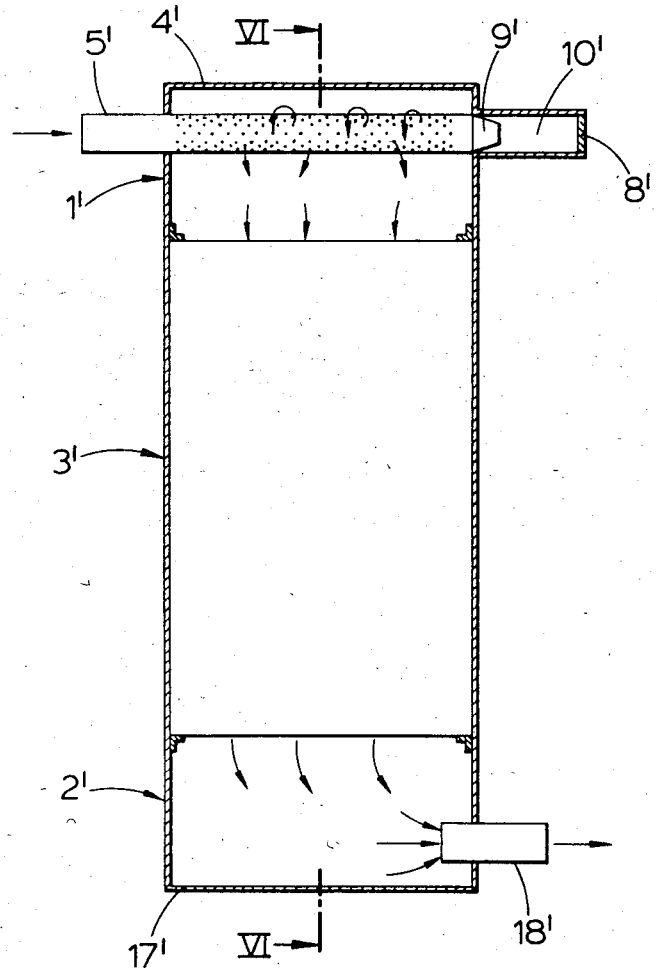
FIG. 5 is a schematic part-sectional plan view of the second form of silencer.
Figure 6:
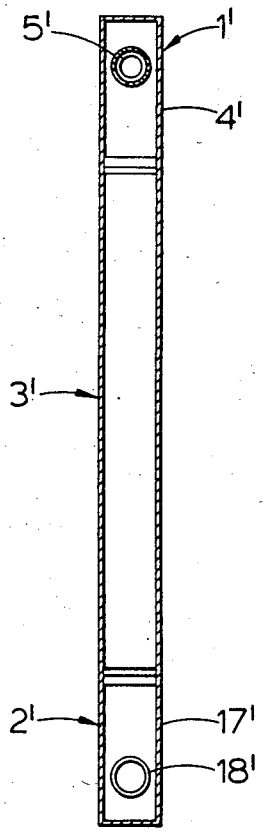
FIG. 6 is a schematic cross-section taken on the line VI—VI of FIG. 5.

FIGS. 5 and 6 show a second form of exhaust silencer. This silencer is similar to the first form of silencer, and so like (but primed) reference numerals will be used for like parts. The silencer of FIGS. 5 and 6 has an inlet section 1', an outlet section 2', and a noise-attenuation section 3' positioned between the inlet and outlet sections. The inlet section 1' is constituted by a rectangular box 4', and an inlet pipe 5'. The box 4' is made of sheet metal. The inlet pipe 5' is connected to the exhaust manifold (not shown) of an internal combustion engine. The portion of the inlet pipe 5' within the box 4' is perforated to permit exhaust gases to pass from the pipe into the box (as indicated by the arrows). The pipe 5' passes right through the box 4', and is closed off by an end plate 8'. Where the pipe 5' passes through the wall of the box 4', it contains a nozzle 9'. The nozzle 9' opens into the end portion 10' of the pipe 5', this end portion lying outside the box 4', and constituting a collection chamber 10' for heavier particles within the exhaust gas.

Figure 3:
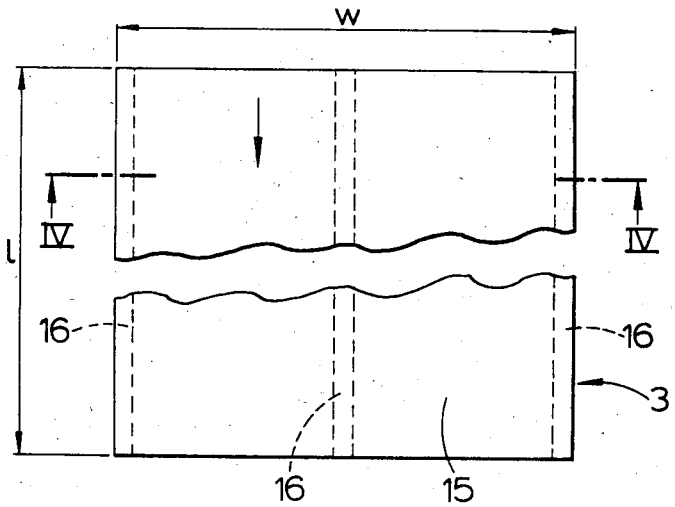
FIG. 3 is a plan view of part of the silencer of FIG. 1.

The noise-attenuation section 3' is identical with that shown in FIGS. 3 and 4, except that there are twenty three flat plates 15, these plates being made of stainless steel. The plates 15 have the same thickness (0.8 millimetres) as the separating strips 16.

The outlet section 2' is constituted by a rectangular box 17' and an outlet pipe 18'. The box 17' is made of sheet metal. As shown, both the boxes 4' and 17' have the same cross-section as the housing 12 of the noise-attenuation section 3'. Indeed, it is preferable if the boxes 4' and 17' are formed integrally with the housing 12.

In each of the embodiments, the degree of attenuation of sound in the exhaust gas is mainly determined by the depth $^{d}$ and the length $^{l}$ of each of the streams of gas flow within the matrix 13, and the velocity of sound in gas. The attenuation is governed by Rayleigh's theory, which is too complex to discuss here. However, the width $^{w}$ of the matrix 13 is determined by the back pressure permitted for the particular engine to which the silencer is connected, and the number of streams. When $^{d}$ is small, the influence of the internal fluid friction of the gas (that is to say its viscosity) plays a major part in reducing the amplitude of the sound vibrations in the gas, particularly when the gas is in contact with a large surface area of solid materials. Consequently, the smaller the depth $^{d}$ the less is the length $^{l}$ required to obtain a given degree of attenuation. For example, for a 100 brake horse power diesel engine, and a silencer having twentyfour ceramic plates 15, 3 millimeters thick, the following dimensions have been found to be suitable: $^{d}=0.5$ millimeters, $^{l}=330$ millimeters, and $^{w}=660$ millimeters. For the same engine, and a silencer having twenty three stainless steel plates 15, the following dimensions have been found to be suitable: $^{d}=0.8$ millimeters, $^{l}=660$ millimeters, and $^{w}=330$ millimeters. In the latter case, the thickness of the plates 15 was the same as the spacing ($^{d}$) between the plates.

It will also be apparent that the number of the plates 15 (and hence the number of streams of exhaust gas) could be varied widely to suit different requirements.

I claim:

1. An exhaust silencer comprising an enclosure defining a chamber of rectangular cross section, one transverse dimension of which is greater than the other, an inlet pipe disposed within the chamber at one end transversely of the transverse dimension of greater length, one end of which enters the chamber at one side and the other end of which extends from the chamber at the other side, a nozzle at said other end exteriorly of the chamber, said inlet pipe containing within the chamber a plurality of perforations providing communication between the inlet pipe and the interior of the chamber, an outlet at the other end of the chamber and noise attenuating means disposed in the chamber between the inlet pipe and the outlet comprising a plurality of spaced, parallel, imperforate flat plates made of heat and corrosion-resistant material, said plates corresponding in width to the longer transverse dimension of the chamber and of a length corresponding to substantially the length of the chamber between the inlet pipe at the one end and the outlet at the other end.

2. An exhaust silencer according to claim 1 comprising a collection chamber at said one end of the chamber disposed about the nozzle.

3. An exhaust silencer comprising an enclosure defining a chamber of rectangular cross section, one transverse dimension of which is greater than the other, an inlet pipe disposed within the chamber at one end transversely of the transverse dimension of greater length, one end of which enters the chamber at one side and the other end of which exits from the other side, a nozzle at said other end exteriorly of the chamber, said inlet pipe containing within the chamber a plurality of perforations providing communication between the inlet pipe and the interior of the chamber, an outlet at the other end of the chamber comprising a tubular member disposed transversely of the longer transverse dimension of the chamber provided at one end with an outlet pipe and containing an elongate aperture in communication with the interior of the chamber through which the exhaust gases can pass from the chamber to the outlet pipe.

4. An exhaust gas silencer for an internal combustion engine comprising an enclosure defining a tubular inlet chamber, a rectangular attenuation chamber and a tubular outlet chamber, an inlet pipe disposed within the inlet chamber with one end entering the inlet chamber at one side and the other end extending from the inlet chamber at the other side, aperture plates at the opposite sides of the inlet chamber supporting the inlet pipe therein, said inlet pipe between the aperture plates containing a plurality of perforations and said tubular inlet chamber containing an elongate aperture in communication with the attenuation chamber, said attenuation chamber being of rectangular cross section, one transverse dimension of which is substantially larger than the other transverse dimension, a noise attenuation matrix disposed in the attenuation chamber in the form of a matrix comprised of a plurality of imperforate flat plates made of a material which is heat-resistant and corrosion-resistant, the plates being placed in spaced, parallel relation and corresponding in width to the greater transverse dimension of the attenuation chamber and in length to substantially the length of the attenuation chamber.

5. A silencer according to claim 4 wherein there is a nozzle at the end of the inlet pipe extending from the opposite side of the inlet chamber.

6. A silencer according to claim 5 comprising a collection chamber disposed about the nozzle.

7. A silencer according to claim 6 wherein the collection chamber comprises an extension of the tubular inlet chamber.

8. An exhaust gas silencer for an internal combustion engine, the silencer having an inlet, a noise attenuation chamber containing a noise attenuation matrix and an outlet, wherein the noise attenuation chamber is of rectangular cross section and has one transverse dimension which is substantially greater than the other transverse dimension and wherein the noise attenuation matrix comprises a plurality of imperforate flat plates made of a material which is heat-resistant and corrosion-resistant, the plates being disposed in spaced, parallel relation parallel to the direction of flow of the gases from the inlet to the outlet and constraining gas flow in a direction exclusively parallel to the plates and wherein the inlet includes a perforated inlet plate mounted within a tubular member which is fixed to the noise attenuation chamber and wherein the tubular member has an elongate aperture which opens into the noise attenuation chamber.

9. An exhaust gas silencer for an internal combustion engine, the silencer having an inlet, a noise attenuation chamber containing a noise attenuation matrix, and an outlet, wherein the noise attenuation chamber is of rectangular cross section and has one transverse dimension which is substantially larger than the other transverse dimension, and wherein the noise attenuation matrix comprises a plurality of imperforate flat plates made of a material which is heat-resistant and corrosion-resistant, the plates being placed in spaced, parallel relationship parallel to the direction of flow of the gases from the inlet to the outlet and constraining gas flow in a direction exclusively parallel to the plates, wherein the inlet includes a perforated inlet pipe, and wherein the inlet pipe contains a nozzle, the nozzle being positioned within a portion of the inlet not in the flow path of gas to the noise attenuation chamber.

10. An exhaust gas silencer for an internal combustion chamber, the silencer having an inlet, a noise attenuation chamber containing a noise attenuation matrix, and an outlet, wherein the noise attenuation chamber is of rectangular cross section and has one transverse dimension which is substantially larger than the other transverse dimension, and wherein the noise attenuation matrix comprises a plurality of imperforate flat plates made of a material which is heat-resistant and corrosion-resistant, the plates being placed in spaced, parallel relationship parallel to the direction of flow of the gases from the inlet to the outlet and constraining gas flow in a direction exclusively parallel to the plates, wherein the inlet includes a perforated inlet pipe mounted within a tubular member which is fixed to the noise attenuation chamber, and wherein the tubular member has an elongate aperture which opens into the noise attenuation chamber.

* * * * *